US007084727B2

(12) United States Patent
Bauer et al.

(10) Patent No.: US 7,084,727 B2
(45) Date of Patent: Aug. 1, 2006

(54) SWITCHING DEVICE COMPRISING A UNIFORM CONTROL TILE

(75) Inventors: Markus Bauer, Weiden (DE); Peter Hartinger, Bodenwöhr (DE); Stefan Merz, Heroldsbach (DE); Rolf Müller, Ebermannsdorf (DE); Ludwig Niebler, Laaber (DE); Joe Rogers, Norcross, GA (US)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/485,354

(22) PCT Filed: Jul. 18, 2002

(86) PCT No.: PCT/DE02/02637

§ 371 (c)(1),
(2), (4) Date: Jan. 30, 2004

(87) PCT Pub. No.: WO03/017303

PCT Pub. Date: Feb. 27, 2003

(65) Prior Publication Data

US 2004/0217831 A1 Nov. 4, 2004

(30) Foreign Application Priority Data

Jul. 31, 2001 (DE) ..... 101 37 497

(51) Int. Cl.
*H01H 67/02* (2006.01)

(52) U.S. Cl. ..... 335/132; 335/202; 200/293

(58) Field of Classification Search ..... 335/6, 335/132, 202, 8–10; 200/293–308; 439/810–814
See application file for complete search history.

(56) References Cited

U.S. PATENT DOCUMENTS

| | | | | |
|---|---|---|---|---|
| 3,501,723 | A * | 3/1970 | Marien | 335/202 |
| 4,539,541 | A * | 9/1985 | Bharteey et al. | 335/132 |
| 4,595,812 | A * | 6/1986 | Tamaru et al. | 200/307 |
| 5,483,212 | A * | 1/1996 | Lankuttis et al. | 335/132 |
| 6,285,271 | B1 * | 9/2001 | Bauer et al. | 335/132 |
| 6,379,196 | B1 * | 4/2002 | Greenberg et al. | 439/801 |
| 6,733,347 | B1 * | 5/2004 | Palet Mercader et al. | 439/810 |

FOREIGN PATENT DOCUMENTS

| | | |
|---|---|---|
| DE | 4234619 | 9/1994 |
| DE | 29508610 | 9/1995 |
| DE | 19638653 | 4/1998 |
| DE | 10061564 | 6/2001 |
| EP | 0511043 | 10/1992 |
| EP | 0748018 | 12/1996 |

OTHER PUBLICATIONS

Four (4) pages - excerpts from the Main Catalogue of ABB Schalt –und Steuerungstechnik GmbH, Heidelberg: pp. 0/0, 0/1, 4/5 and 4/7.

* cited by examiner

*Primary Examiner*—Lincoln Donovan
(74) *Attorney, Agent, or Firm*—Harness, Dickey & Pierce, LLC

(57) ABSTRACT

The aim of the invention is to provide a switching device (1) based on a uniform control tile, which is easy to produce and assemble, ensuring good electric insulation properties. To achieve this, the device comprises an adapter (12) with second contact means (13), arranged to form a connection between first contact means (7, 8) and a conductor (10) that is to be connected. Said adapter and second contact means have insulating isolating elements (18, 18*a*, 18*b*, 18*c*), at least bordering several sides, for defined creepage distances and clearances.

18 Claims, 2 Drawing Sheets

SWITCHING DEVICE COMPRISING A UNIFORM CONTROL TILE

This application is the national phase under 35 U.S.C. § 371 of PCT International Application No. PCT/DE02/02637 which has an International filing date of Jul. 18, 2002, which designated the United States of America and which claims priority on German Patent Application number DE 101 37 497.6 filed Jul. 31, 2001, the entire contents of which are hereby incorporated herein by reference.

FIELD OF THE INVENTION

The invention generally relates to a switching device, in particular a protective switching device.

BACKGROUND OF THE INVENTION

A connecting unit of this type for a multipole switch with a main enclosure is known from DE 100 61 564 A1. This connecting unit contains an auxiliary enclosure and connecting conductors which, at one of their ends each have a connection section connected to an associated connecting terminal of the switch, and which, at their other end, have a connecting section for connection of a cable wire. The connection sections project outward from the auxiliary enclosure. Further, the connecting sections are surrounded by the auxiliary enclosure. The interior of the auxiliary enclosure is subdivided by phase isolation walls into wiring areas for the individual poles.

Switching devices of this type withstand the loads that occur when switching electrical equipment on and off, both in the sound operating state and in the faulty operating state. If necessary, a further embodiment of a switching device such as this in the form of a protective switching device also complies with overload and short-circuit conditions.

A switching device is known from EP 0 511 043 A1. In this case, if is designed such that it has an additional contact block. The contacts of the contact block are coupled to the switching mechanism of the switching device.

A protective switching device of the second-mentioned type is known from DE 196 38 653 C1. In this case, an auxiliary switch additional block is used for insertion into an enclosure opening in an electrical switching device with main contacts. The contacts of the auxiliary switch additional block are connected to the main contacts of the switching device.

It is also generally known for plugs to which wiring has already been fitted to be used for quick connection, and if necessary with incorrect polarity protection, to appliances or terminal strips.

SUMMARY OF THE INVENTION

An object of an embodiment of the present invention is to specify a switching device which can be produced, assembled and installed easily on the basis of the standard switch module, bearing in mind electrical insulation and isolation characteristics that have to be ensured.

According to an embodiment of the invention, this object may be achieved by a switching device.

The redesign, which can be avoided by way of an embodiment of the invention, of the already available standard switch module which satisfies fundamental requirements is caused by the fact that it is possible to add the switch module in a manner which is simple from the manufacturing, assembly and installation points of view, on the basis of a high electrical dielectric strength that has to be ensured. An embodiment of the invention is particularly suitable for use in a protective switching device. Furthermore, an embodiment of the invention may include an adapter that can be mounted on the existing connecting device for the switching device. As such, a standardized switching device, for example in accordance with IEC 60947, can be retrofitted as required in a very simple manner to form a so-called "Self-protected type E combination controller" in accordance with UL 508.

The switch unit advantageously has at least one adapter in each case on the input side and on the output side. Thus, the switch module can be matched in a simple manner to the requirements of UL 489, thereby satisfying the requirements for a circuit breaker in accordance with the standards.

In one preferred refinement, at least two angled disconnecting elements are in each case provided for each contact device, so that large isolating gaps are achieved using little material.

At least one frame-like disconnecting element is advantageously in each case provided for each contact device, thus forming a large air gap and creepage distance in a simple manner.

The second contact device advantageously has an associated holding area for connection of at least one of the conductors, thus providing a reliable and rapid contact in a simple manner.

The holding area is advantageously subdivided. Further, at least one of the conductors can in each case be connected in each part. This thus improves the geometric configuration of the adapter. In this case, two conductors can be clamped, for example one above the other, and this results in a space saving which allows two or more disconnecting elements to be arranged between the contact device.

The adapter can advantageously be arranged and/or fixed on the switch unit in an interlocking manner, thus allowing the adapter to be fitted easily and with an accurate fit, forming a homogeneous enclosure surface.

The first contact device can advantageously be covered by a panel. As such, this results in a closed enclosure in this area, thus avoiding dirt, which could assist the formation of a creepage path.

BRIEF DESCRIPTION OF THE DRAWINGS

The present invention will become more fully understood from the detailed description of preferred embodiments given hereinbelow and the accompanying drawings, which are given by way of illustration only and thus are not limitative of the present invention, and wherein.

DETAILED DESCRIPTION OF THE PREFERRED EMBODIMENTS

In the following text, identical parts in the figures are provided with the same reference symbols or, in the same sense, with similar reference symbols.

Figure 1:
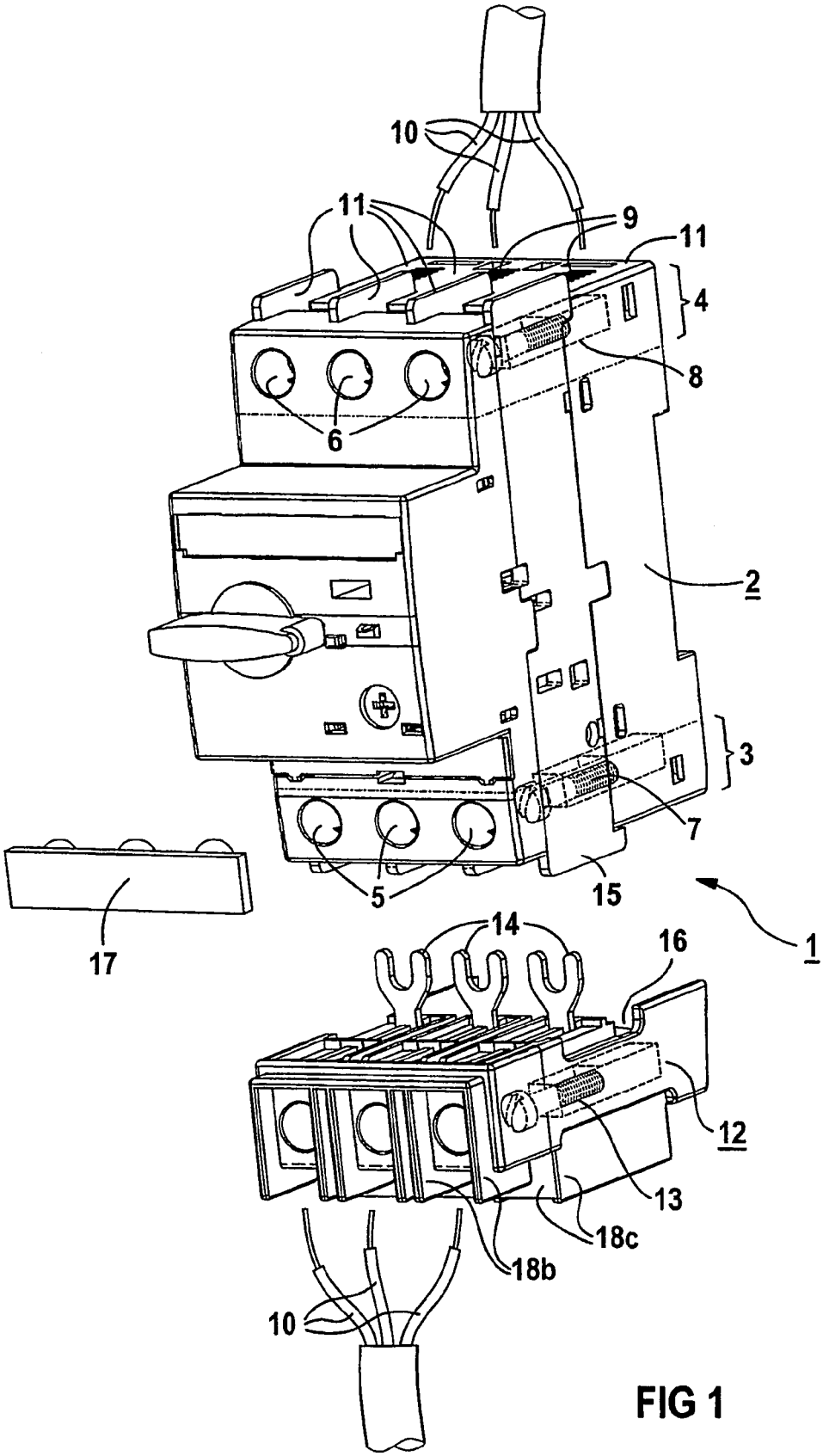
FIG. 1 shows a protective switching device with an adapter and with a panel, in the form of a three-dimensional illustration.

FIG. 1 shows a switching device 1 with a standard switch module 2 which can be used universally and has a first and a second permanently integrated connecting unit 3 and 4, respectively. The switching device 1 may, in particular, be in the form of a protective switching device. Three accesses 5;

6 are in each case arranged at the front, that is to say on the control face or surface, for a first contact device 7 or 8, respectively, (which is illustrated schematically here) for the two respective connecting units 3 and 4.

The first contact device 7; 8 includes so-called combination screws, which each have a connecting terminal with a covering disk. A first and a second connecting area 9, which is illustrated in the form of an attachment here, for conductors 10 that are to be connected are provided at right angles to the accesses 5; 6, and thus on the insertion side. Isolating enclosure parts 11 are in each case arranged between two adjacent contact device 7; 8, and may be in the form of webs and/or may be flush with the surface.

An adapter 12 can be arranged on the switch unit 2, and has at least one second contact device 13, which is illustrated schematically here. The second contact device 13 is provided with at least one connecting element 14, and is electrically conductively connected to it. The connecting element 14 can be electrically and mechanically connected to the first or to the second corresponding contact device 7 or 8, respectively, of the switch unit 2. The switching device 1 is accordingly composed of the switch unit 2 and of the adapter 12 which is connected to it.

The adapter 12 can advantageously be arranged in an interlocking manner, in particular by way of a molding 15 and a cutout 16, on the switch unit 2, so that it is possible to form a switching device unit. This may be done simply by mounting the adapter 12 on the switch unit 2, without in the process having to remove components of the switching device 1. In this case, the adapter 12 provides incorrect polarity protection and thus contributes to reducing possible connection faults. The accesses 5; 6 to the two connecting units 3 and 4, respectively, may also be covered at the front by a panel 17, thus resulting in an advantageous enclosure termination of the switching device 1. An insertion panel which closes the accesses 5; 6 is likewise possible in the form of an enclosure termination in a further embodiment.

The adapter 12 also has disconnecting elements 18, which hold the second contact device 13 on the front and on the insertion side, at least on two sides. The disconnecting elements 18 are used to improve the isolation characteristics, in particular with regard to air gaps and creepage distances which can be defined between two adjacent contact devices 13 or between the second contact device 13 and an electrically conductive part in or on the switching device 1. The disconnecting elements 18 may be designed in various design variants as shown in FIG. 2, as wall-like disconnecting elements 18*a*, in the form of angled disconnecting elements 18*b* or frame-like disconnecting elements 18*c*, or else may be designed as partition walls or ribs.

Figure 2:
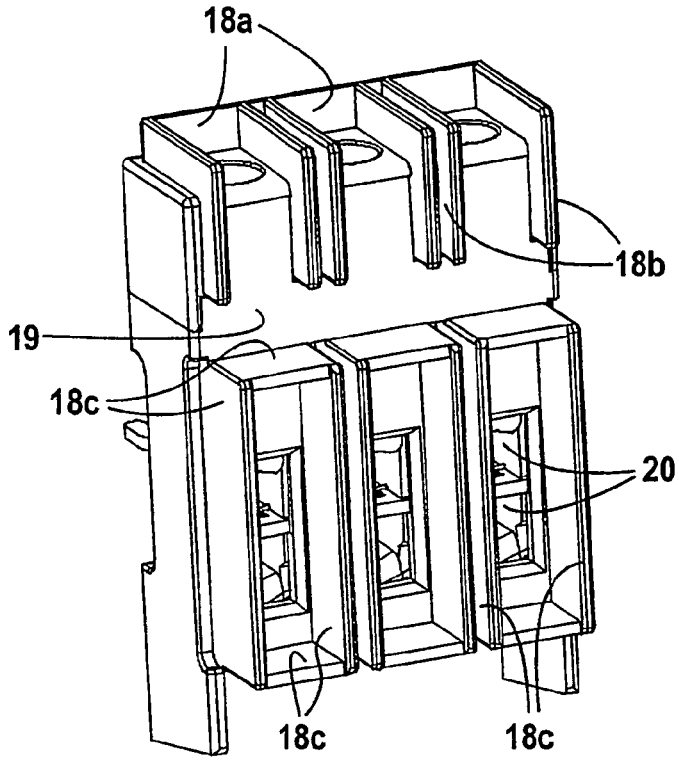
FIGS. 2 and 3 show a front view and a rear view, respectively, of an adapter as shown in FIG. 1.

FIG. 2 shows a three-dimensional front view illustration of the adapter 12 as shown in FIG. 1, with at least two wall-like disconnecting elements 18*a* in each case being arranged laterally for every second contact device 13 in order to improve the isolation characteristics of the adapter with minimal complexity and/or the contact device 13 in each case having disconnecting elements 18*b* which are angled on an insertion-side surface 19 adjacent to the front face.

On the insertion side, the contact device 13 also have frame-like disconnecting elements 18*c* which, in this embodiment, are in the form of a closed frame and/or form an air gap of ≧1 inch and a creepage distance of ≧2 inches, with these gaps and distances advantageously also satisfying stringent requirements for isolation characteristics that have to be complied with.

A refinement such as this for the standard, standardized switch unit 2 according to IEC 60947 is particularly advantageous since there is no need whatsoever to carry out any cost-increasing adaptation work or modifications. An adapter 12 can thus advantageously be used for upgrading purposes to form a so-called self-protected type E combination controller in accordance with UL 508, or a so-called circuit breaker in accordance with UL 489.

Since the adapter 12 has its own second contact device 13, this results in a high degree of freedom for the geometrical configuration. In the illustrated embodiment, the second contact device 13 are in the form of connecting terminals, each having a holding area 20. The holding areas 20 are in this case subdivided so that two conductors 10 to be connected can be accommodated for every second contact device 13. The holding areas 20 are advantageously located one above the other so that, for example, three contact devices 13 each having two disconnecting elements 18 can be accommodated with the adapter 12 having a physical width of 45 mm.

As an alternative to this, the connecting areas 20 can be arranged alongside one another, in which case one disconnecting element 18 can be located between the contact devices 13, with the same physical width. A disconnecting element height of ≧1 inch, instead of half an inch in accordance with the embodiment mentioned above, can accordingly be provided between two adjacent contact devices 13 in order to achieve a creepage distance of ≧2 inches. Other air gaps and creepage distances which differ from those stated above may, of course, also be used in a similar manner. It is thus possible to comply with individual requirements of individual countries and their regulations.

Figure 3:
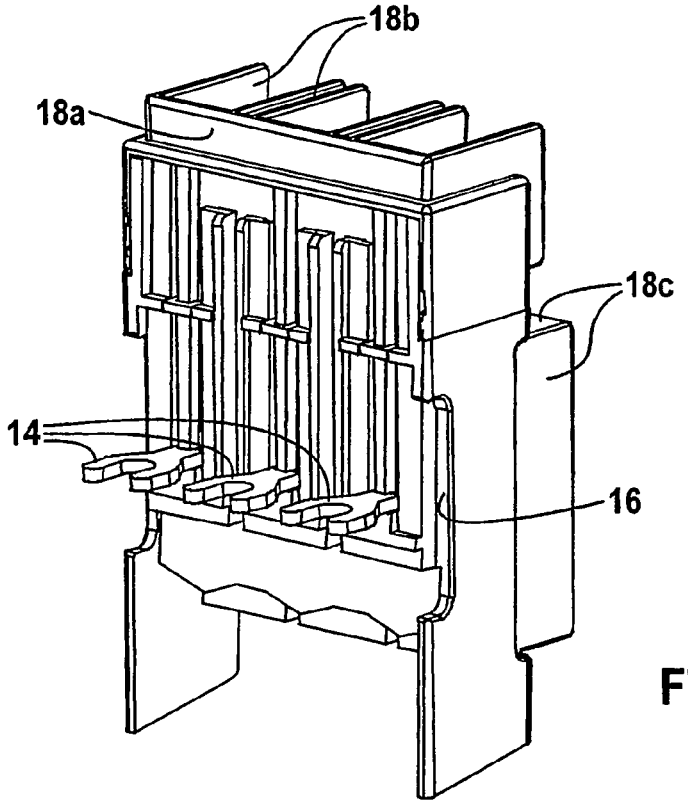

FIG. 3 shows a rear view of the adapter 12 as shown in FIGS. 1 and 2, with Y-shaped connecting elements 14.

The type of refinement of the standard switch unit 2 as described above to ensure electrical isolation characteristics and subject to the requirement for simplicity of manufacture, assembly and installation can be used in the same or in a modified version for a circuit breaker, for a motor circuit breaker or for a power breaker. This can also equally well be transferred to an electromagnetic switching device or to a device installed in a row of devices, such as a contactor or a relay.

The main essence of the present idea is to achieve a switching device 1 which can be manufactured, assembled and installed easily on the basis of a standard switch unit 2 and with respect to electrical isolation characteristics to be ensured, with an adapter 12, which can be arranged in a connection between a first contact device 7; 8 and a conductor 10 to be connected, being provided, having a second contact device which, in the sense of defined air gaps and creepage distances, has isolating disconnecting elements 18 which are held on at least two sides.

The invention claimed is:

1. A switching device, comprising:

a standard switch unit, including at least one permanently integrated first contact device for at least one first conductor that is connectable to the switching device;

at least one associated isolating enclosure part for each at least one first contact device;

at least one adapter, independent of the standard switch unit, arrangeable in a connection between the standard switch unit and at least one second conductor and including a second contact device, the second contact device being contactable with the at least one second conductor and with the switch unit;

at least one isolating element designed and arranged to provide an air gap of ≧1 inch and a creepage distance of ≧2 inches for the second contact device;

wherein the at least one isolating element includes a partition wall projecting from a surface of the at least one adapter;

wherein the partition wall projects further from the adapter than the second contact device.

2. The switching device as claimed in claim 1, wherein at least one adapter is provided on each of an input side and an output side of the switching device.

3. The switching device as claimed in claim 1, further comprising at least two angled isolating elements for the second contact device.

4. The switching device as claimed in claim 1, wherein the switching device includes at least one frame-type isolating element for the second contact device.

5. The switching device as claimed in claim 1, wherein the second contact device includes an associated holding area for connection of the at least one second conductor.

6. The switching device as claimed in claim 1, wherein the holding area is subdivided, and at least one second conductor is connectable in each subdivided portion of the holding area.

7. The switching device as claimed in claim 1, wherein the adapter is arranged on the standard switch unit in an interlocking manner.

8. The switching device as claimed in patent claim 1, wherein the first contact device is covered by a panel.

9. The switching device as claimed in claim 1, wherein the switching device is a protective switching device.

10. The switching device as claimed in claim 2, further comprising at least two angled isolating elements for the second contact device.

11. The switching device as claimed in claim 10, wherein the switching device includes at least one frame-type isolating element for the second contact device.

12. The switching device as claimed in claim 11, wherein the second contact device includes an associated holding area for connection of the at least one second conductor.

13. The switching device as claimed in claim 12, wherein the holding area is subdivided, and at least one second conductor is connectable in each subdivided portion of the holding area.

14. A switching device, comprising:

a switch unit with at least one permanently integrated first means for contacting at least one first conductor that is connectable to the switching device;

at least one means for isolating each at least one first means for contacting;

at least one adapter, independent of the switch unit, including a second means for contacting at least one second conductor and the switch unit;

isolating means for providing an air gap of ≧1 inch and a creepage distance of ≧2 inches for the second means for contacting;

wherein the isolating means includes a partition wall projecting from a surface of the at least one adapter;

wherein the partition wall projects further from the adapter than the second means.

15. The switching device as claimed in claim 14, wherein at least one adapter is provided on each of an input side and an output side of the switch unit.

16. The switching device as claimed in claim 14, wherein the switching device includes at least two angled isolating elements for the second means for contacting.

17. The switching device as claimed in claim 14, wherein the switching device includes at least one frame-type isolating element for the second means for contacting.

18. A switching device, comprising:

a switch unit with a contact device; and an adapter having a housing, a cooperating contact device, which is mounted in the housing, for electrically connecting to the contact device of the switch unit, and a partition wall projecting from a surface of the housing;

wherein the partition wall projects further from the housing than the cooperating contact device; and wherein the partition wall provides a creepage distance of ≧2 inches for the cooperating contact device.

* * * * *